US006648524B2

(12) United States Patent
Hehn et al.

(10) Patent No.: US 6,648,524 B2
(45) Date of Patent: Nov. 18, 2003

(54) DEVICE FOR REMOVING MOISTURE FROM SHEETS OF PHOTOGRAPHIC MATERIALS

(75) Inventors: Wilfried Hehn, München (DE); Ernst Schweiger, Feldkirchen (DE); Stefan Huber, München (DE)

(73) Assignee: Agfa-Gevaert Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/251,510

(22) Filed: Sep. 19, 2002

(65) Prior Publication Data

US 2003/0059220 A1 Mar. 27, 2003

(30) Foreign Application Priority Data

Sep. 21, 2001 (EP) ..... 01122803

(51) Int. Cl.[7] ..... G03D 3/08

(52) U.S. Cl. ..... 396/612; 396/614; 396/617; 396/620; 355/27

(58) Field of Search ..... 399/612, 614, 399/617, 620, 625; 355/27–29; 34/70, 71

(56) References Cited

U.S. PATENT DOCUMENTS

| | | | | |
|---|---|---|---|---|
| 4,117,604 A | * | 10/1978 | Burg et al. | 34/70 |
| 4,127,082 A | * | 11/1978 | Kawabata | 399/239 |
| 5,241,759 A | * | 9/1993 | Weidlich et al. | 34/71 |
| 5,339,129 A | | 8/1994 | Hehn et al. | |
| 5,369,458 A | | 11/1994 | Wernicke et al. | |

FOREIGN PATENT DOCUMENTS

EP 0 302 956 A1 8/1987

* cited by examiner

*Primary Examiner*—Della J Rutledge
(74) *Attorney, Agent, or Firm*—Darby & Darby

(57) ABSTRACT

A device for removing moisture from individual sheets of a photographic material has a pair of transport rollers at the incoming side and another pair of transport rollers at the exit side of the device. Arranged between the roller pairs is a squeeze-out surface with a wiper blade set against the squeeze-out surface.

9 Claims, 1 Drawing Sheet

DEVICE FOR REMOVING MOISTURE FROM SHEETS OF PHOTOGRAPHIC MATERIALS

BACKGROUND OF THE INVENTION

The invention relates to a device for removing moisture from materials in the form of individual sheets carrying a photographic layer. The device is equipped with a pair of transport rollers at the incoming side and another pair of transport rollers on the exit side.

Carrier materials in sheet form for photographic layers, such as for example individual sheets of exposed photographic paper, are customarily developed only in so-called minilabs. In large laboratories, on the other hand, the individual pictures are exposed onto long strips of paper that are cut into individual sheets only after they have been developed and dried. The long paper strips can be processed with significantly simpler means than the individual sheets. Also, long paper strips allow higher throughput speeds. The reason for the lower complexity and higher speed lies in the fact that long paper strips can be processed practically without any threading-in operations. It is normal practice to glue the end of one paper strip to the beginning of the next strip. If the machine is turned off for cleaning or servicing, a leader strip is placed in the machine as a means for pulling the beginning of a new photographic paper strip through the machine when the latter is started up again.

In the processing of individual sheets, on the other hand, the front edge of each sheet has to be threaded into each processing device or each pair of transport rollers along the processing path through the machine. This also applies to devices for removing moisture from the photographic materials between the individual wet-processing stages and before the drier.

Under the existing state of the art, the moisture removal in machines for developing individual sheets—in contrast to machines for developing strip material in large laboratories—has therefore been performed exclusively by means of squeeze-out rollers as described also in the published German patent application DE 41 41 192 A1. In order to improve the poor moisture-removing performance of the squeeze-out rollers, the aforementioned publication proposes the concept of using a combination of several pairs of squeeze-out rollers after each processing bath, so that each sheet runs through at least two pairs of squeeze-out rollers. It was found, however, that even with three pairs of squeeze-out rollers, a very large amount of processing fluid is taken along from one processing tank to the next by the sheets of photographic material. Increasing the number of squeeze-out rollers even further is not considered to be feasible in view of the additional cost and the space required.

OBJECT OF THE INVENTION

The present invention therefore has the object of proposing a device for removing moisture from photographic materials that are processed in the form of individual sheets, so that the device fits into a compact space and ensures a good moisture-removal rate.

SUMMARY OF THE INVENTION

A moisture-removing device according to the invention is equipped with a first pair of transport rollers at the incoming side and a second pair of transport rollers at the exit side. A stationary squeeze-out surface and an elastic wiper blade set against the squeeze-out surface are arranged in the path between the first roller pair and the second roller pair. Using a wiper blade in connection with a squeeze-out surface placed in the path between two transport roller pairs strongly improves the effectiveness of the moisture removal in particular for small sheet formats. As a result, a much smaller part of the processing fluid adhering to the photographic sheets is taken along from one processing bath to the next. This offers the benefit that the individual processing baths need to be refreshed less often. At the same time, a higher image quality can be achieved, for example by avoiding traces caused by developer fluid running down the surfaces of the photographs.

It is advantageous if the squeeze-out surface has a low coefficient of friction to prevent the leading edges or the leading portions of the photographic sheets from adhering to the squeeze-out surface. A sheet clinging to the squeeze-out surface would cause a paper jam, which could destroy the affected sheet or would at least necessitate a manual intervention to correct the malfunction.

To avoid the possibility of a paper jam with an even higher degree of assurance, the squeeze-out surface is inclined at an angle between 5° and 15° in relation to the plane of the transport path of the photographic sheets. Positioning the squeeze-out surface at an angle within this range ensures a safe entry of the leading edges of the sheets between the wiper blade and the squeeze-out surface without blocking the advancement of the leading edge. Also, inclining the squeeze-out surface at an angle within the proposed range prevents that a surface portion of the sheet could cling to the squeeze-out surface.

Photographic paper that has already been transported through a processing tank has a low degree of stiffness. If the leading edge of an individual sheet being advanced by the first pair of transport rollers meets with an obstacle, as represented by the wiper blade and the squeeze-out surface, the sheet can easily be curled into a loop, which will lead to a malfunction. Since the stiffness of the paper decreases progressively the more the leading edge projects from the gap of the first roller pair, the distance of the wiper blade from the first roller pair has to be carefully matched to the contact pressure of the wiper blade against the squeeze-out surface. Good results in the removal of moisture were found to be achievable if the contact pressure of the wiper blade is set so that a photographic sheet can be pulled through the gap between the wiper blade and the squeeze-out surface by applying a width-related pulling force between 5 Newton and 30 Newton per meter of paper width. With a contact pressure determined in this manner, the distance between the first roller pair and the wiper blade should not exceed 40 millimeters.

To ensure an adequate useful operating life of the wiper blade without having to accept scratches on the image surface, blades with a Shore hardness of up to 90° have been proven to work well.

The useful operating life of the wiper blades can be improved enormously by taking measures to ensure that the sharp lateral edges of the photographic sheets are not constantly passing the same places on the wiper blades. It is therefore proposed according to the invention to transport the individual sheets through the developing apparatus so that they follow each other in laterally staggered positions rather than in a straight line. It is advantageous to individually determine the lateral offset of each photographic sheet in relation to the immediately preceding sheet, for example by means of a random number generator.

The novel features that are considered as characteristic of the invention are set forth in particular in the appended claims. The improved moisture-removing device itself, however, both as to its construction and its mode of operation, together with additional features and advantages thereof, will be best understood from the following detailed description of a presently preferred specific embodiment with reference to the accompanying drawing.

BRIEF DESCRIPTION OF THE DRAWING

The detailed description of a preferred embodiment which follows below is based on the attached drawings which are intended as examples and are not to be interpreted as limitations on the scope of the invention.

DETAILED DESCRIPTION OF PREFERRED EMBODIMENTS

Figure 1:
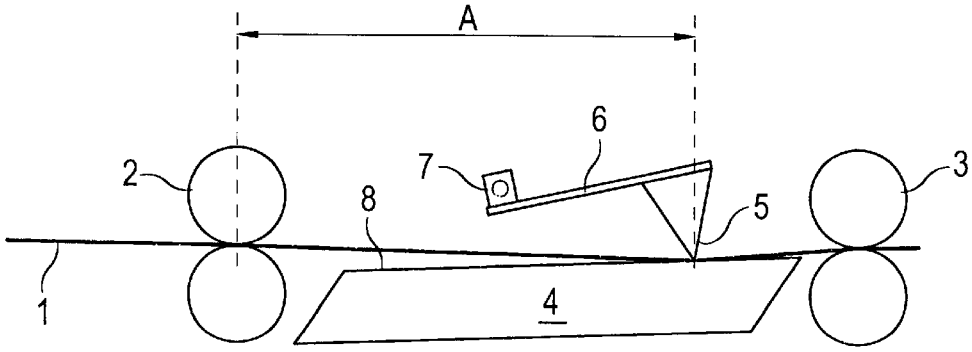
FIG. 1 represents a schematic view of the device according to the invention.

FIG. 1 illustrates a moisture-removing device with a first transport-roller pair 2 at the incoming side and a second transport-roller pair 3 at the exit side of the device. An inclined guide ramp 4 with a squeeze-out surface 8 is arranged between the roller pairs. The edge of an elastic wiper blade 5 attached to a holder 6 is set against the squeeze-out surface 8. The holder 6 is rotatably attached to the stationary bearing 7. An adjustable spring (not shown in the drawing) acts on the holder 6, so that the wiper blade 5 is pushed against the squeeze-out surface 8 with an adjustable force.

To ensure a trouble-free operation, the distance A between the edge of the elastic wiper blade 5 and the first transport-roller pair 2 should not exceed 40 millimeters.

Setting the squeeze-out surface 8 at an inclined position ensures that only the leading edge of a photographic sheet that is being advanced by the transport-roller pair 2 comes into contact with the squeeze-out surface 8. This prevents that a surface portion of the wet paper could stick to the squeeze-out surface.

The contact pressure of the elastic wiper blade 5 needs to be adjusted, e.g., by means of an adjustable spring (not shown in the drawing), to a pressure level that ensures a trouble-free operation as well as a good result in wiping off moisture. If one measures, e.g., the pulling force needed to pull an individual sheet of the size 13×18 cm in the lengthwise direction through the gap between the wiper blade 5 and the squeeze-out surface 8, the contact pressure should be set to a strength at which the sheet has to be pulled with a force of about 3.5 Newton.

To further reduce the risk of possible malfunctions in the device, it can be advantageous to provide the squeeze-out surface 8 with wide grooves in the direction of the processing path before and after the place where the elastic wiper blade 5 meets the squeeze-out surface, so that only narrow ridges come into contact with the individual sheet, and uninterrupted contact over the full width of the sheet occurs only in the area of the wiper blade. Without reducing the effectiveness of the device, this feature helps in guarding even better against the risk that entire surface portions of the wet underside of the photographic materials could stick to the squeeze-out surface.

Figure 2:
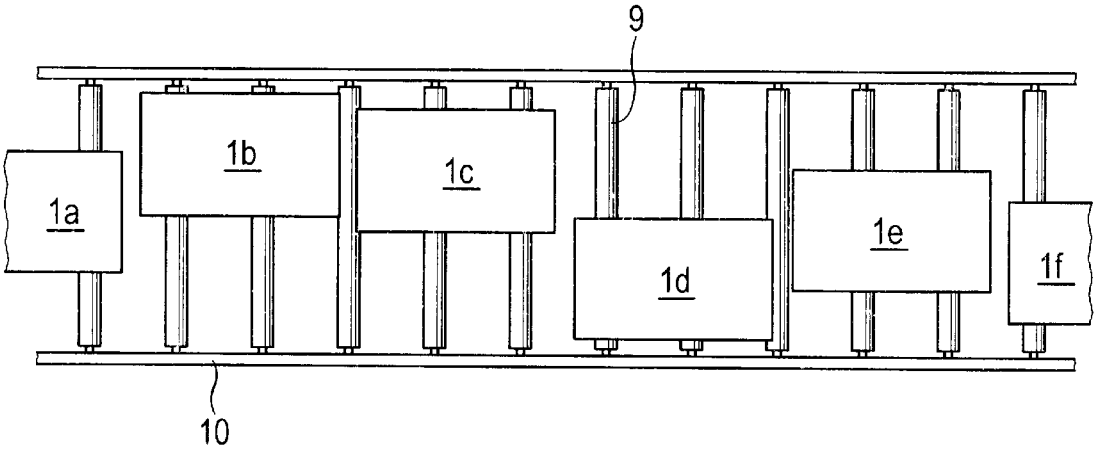
FIG. 2 represents part of a transport device of a developing apparatus according to the invention.

FIG. 2 illustrates a part of a transport device that runs, e.g., through a processing tank of a developing apparatus according to the invention. Transport-roller pairs 9 are supported in a frame 10, but for the sake of clarity of the illustration, only the roller behind the photographic sheets is shown for each roller pair. It is advantageous if the exposed photographic sheets 1*a*–1*f* running through the developing process are randomly staggered over the entire available path width of the transport device. This arrangement ensures that the two sharp lateral edges of each of the sheets 1*a*–1*f* being processed make contact with different portions of the wiper blade 5 (see FIG. 1) of a moisture-removing device according to the invention. The useful operating life of the wiper blade can thereby be prolonged by a multiple factor.

The elements 4 to 8 of FIG. 1 can be installed in the transport device of FIG. 2 at a location above the level of the processing bath between two transport-roller pairs 9. In another embodiment, the device according to FIG. 1 is installed directly in the transition area between two processing tanks.

Without further analysis, the foregoing will so fully reveal the essence of the present invention that others can, by applying current knowledge, readily adapt it for various applications without omitting features that, from the standpoint of prior art, fairly constitute essential characteristics of the generic and specific aspects of our present contribution to the art. Therefore, any such adaptation is meant to be included within the meaning and range of equivalence of the appended claims.

What is claimed is:

1. A device for removing moisture from individual sheets of a material carrying a photographic layer, said device comprising:

an incoming side and an exit side, a first pair of transport rollers arranged at the incoming side and a second pair of transport rollers arranged at the exit side of a transport path through the device, a stationary squeeze-out surface arranged between the first pair of transport rollers and the second pair of transport rollers, and an elastic wiper blade set against the squeeze-out surface.

2. The device of claim 1, wherein the squeeze-out surface comprises a smooth surface with a low coefficient of friction.

3. The device of claim 1, wherein the squeeze-out surface is inclined at an angle between 5° and 15° in relation to the plane of the transport path.

4. The device of claim 1, wherein the elastic wiper blade is arranged at a distance not exceeding 40 millimeters from the first pair of transport rollers.

5. The device of claim 1, wherein the elastic wiper blade has a Shore hardness not exceeding 90°.

6. The device of claim 1, wherein the elastic wiper blade exerts a contact pressure against the squeeze-out surface, and wherein said contact pressure is constant over a width of the device.

7. The device of claim 6, wherein each of said individual sheets has a sheet width and wherein the contact pressure is adjusted in magnitude so that the individual sheets can be pulled through a tight gap between the elastic wiper blade and the squeeze-out surface by applying a width-related pulling force between 5 Newton and 30 Newton per meter of sheet width.

8. An apparatus for developing individual sheets of a material carrying a photographic layer, said apparatus comprising a plurality of processing tanks containing a processing fluid through which the individual sheets are advanced sequentially, also comprising a dryer, and further comprising a device for removing moisture from said individual sheets, said device comprising:

an incoming side and an exit side, a first pair of transport rollers arranged at the incoming side and a second pair of transport rollers arranged at the exit side of a transport path through the device, a stationary squeeze-out surface arranged between the first pair of transport rollers and the second pair of transport rollers, and an elastic wiper blade set against the squeeze-out surface.

9. The apparatus of claim 8, wherein the individual sheets are advanced through the apparatus so that they follow each other in laterally staggered positions in a manner where sharp lateral edges of each of the individual sheets make contact with different portions of the elastic wiper blade.

* * * * *